United States Patent [19]

Fournier

[11] 3,977,753

[45] Aug. 31, 1976

[54] ELECTRICAL TERMINAL ASSEMBLY AND TERMINAL THEREFOR

[75] Inventor: Jacques Fournier, Marly le Roi, France

[73] Assignee: AMP Incorporated, Harrisburg, Pa.

[22] Filed: July 1, 1975

[21] Appl. No.: 592,309

Related U.S. Application Data

[63] Continuation of Ser. No. 469,997, May 15, 1974, abandoned.

[30] Foreign Application Priority Data

Feb. 21, 1974 France ..... 74.06008

[52] U.S. Cl. ..... 339/95 R; 339/276 A

[51] Int. Cl.[2] ..... H01R 9/08

[58] Field of Search ..... 339/17, 95, 97–99, 339/256, 258, 260, 276 A; 317/101 C; 174/88 R; 338/322

[56] References Cited

UNITED STATES PATENTS

| | | | |
|---|---|---|---|
| 3,617,983 | 11/1971 | Patton | 339/98 |
| 3,622,950 | 11/1971 | Millinger | 339/258 R |
| 3,683,319 | 8/1972 | Vigiant et al. | 339/97 R |
| 3,824,527 | 7/1974 | Evans | 339/97 R |
| 3,892,460 | 7/1975 | Izraeli | 339/97 R |

FOREIGN PATENTS OR APPLICATIONS

| | | | |
|---|---|---|---|
| 1,640,630 | 10/1969 | Germany | 339/97 R |

*Primary Examiner*—Joseph H. McGlynn
*Attorney, Agent, or Firm*—William J. Keating; Jay L. Seitchik; Frederick W. Raring

[57] ABSTRACT

In an electrical component support assembly, the lead wires (which are of different gauges) of electrical components, e.g. resistors, are each gripped by the walls of two slots of identical slotted plate terminals. The two slots of each terminal are of the same minimum width but the two slots are laterally offset from one another and the two plates in which the slots are formed are resiliently connected and are formed so that the plates are mutually displaced laterally as the wires are inserted into the slots, whereby the smaller gauge wires are securely gripped between the two plates.

2 Claims, 7 Drawing Figures

ELECTRICAL TERMINAL ASSEMBLY AND TERMINAL THEREFOR

This is a continuation of application Ser. No. 469,997, filed May 15, 1974, now abandoned.

This invention relates to an electrical terminal assembly and a terminal which is suitable for use in such assembly.

There is disclosed in U.S. Pat. No. 2,762,030, an electrical terminal assembly for the connection of electrical circuit components, for example, resistors, which have a lead wire projecting from each end, to external leads and for supporting such components on a panel, the assembly comprising a plurality of electrical terminals which are secured to the panel and which have lead wire receiving slots into which the end portions of the lead wires of the components have been forced at right-angles to the longitudinal axes of such end portions, electrically to connect the lead wires to the terminals.

In such an assembly the lead wire receiving slots of the terminals must be sized broadly in accordance with the gauge of the lead wires. Thus where the components and thus their lead wires are of substantially different sizes it is necessary to use in the assembly terminals having differently sized slots. Not only therefore must the maker of such assemblies keep a stock of different terminals, but the terminals must be distributed on the panel in such a way that the slot sizes of the terminals coincide with particular components to be supported. The present invention is intended for the avoidance of these disadvantages.

According to one aspect of the invention, an electrical terminal assembly for the connection of electrical circuit components, for example, resistors, which have a lead wire projecting from each end, to external leads and for supporting such components on a panel, comprises a plurality of electrical terminals which are secured to the panel and which have lead wire receiving slots into which the end portions of the lead wires of the components have been forced at right-angles to the longitudinal axes of such end portions, electrically to connect the lead wires to the terminals, wherein the lead wires are not all of the same guage, each terminal comprising a pair of subtantially parallel plates arranged in face-to-face relationship, each such plates having a wire receiving slot, the terminals being arranged on the panel in two opposed rows with the plates of all the terminals in substantially parallel relationship, each terminal of one row being arranged opposite to a terminal of the other row, both the slots of one terminal of each pair of opposite terminals receiving the end portion of one lead wire of each component and both the slots of the other terminal of the pair receiving the end portion of the other lead wire of the same component, so that the terminals of the pair cooperate to support the component, at least one slot of each terminal serving tightly to grip the wire end portion, that slot of each terminal, which slot is nearest the body of the electrical component, having a minimum width which is not less than the diameter of the smallest gauge lead wire; and wherein the slots of each terminal are of the same width; the two plates of each terminal cooperating resiliently to grip the end portions of the smallest gauge lead wires.

According to another aspect of the invention, an electrical terminal comprises a pair of parallel plates connected by a bight which has a wire guiding mouth communicating with a lead wire receiving slot in each of the plates, each slot having a wire gripping portion, wherein the plates are substantially contiguous, the wire gripping portions of the slots being mutually misaligned, the plates being connected resiliently by the bight so that the slot portions are moved more nearly into mutual alignment upon the insertion of a common lead wire into both the slot portions by way of the mouth.

For a better understanding of the invention, reference will now be made by way of example to the accompanying drawings, in which.

Figure 1:
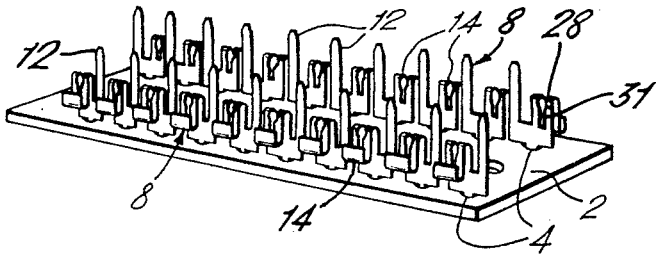
FIG. 1 is a diagrammatic perspective view of an electrical terminal assembly for the connection of electrical circuit components to external leads and for supporting the components on a panel.
Figure 2:
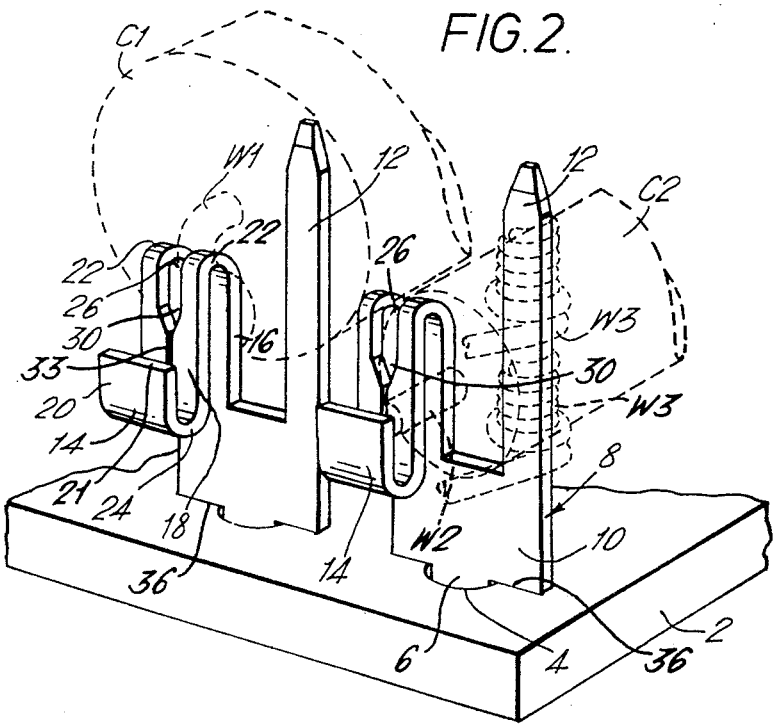
FIG. 2 is an enlarged perspective view of part of the assembly of FIG. 1, showing the manner in which the components are supported on the panel and connected to leads.

Reference will now be made to FIGS. 1 and 2.

Figure 3:
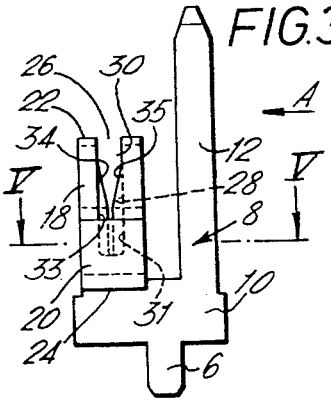
FIG. 3 is a front elevational view of an electrical terminal of the assembly.

An insulating panel 2 has two rows of holes 4 in which are force-fitted lugs 6 of identical electrical terminals 8. Each terminal comprises a flat base 10 from the lower (as best seen in FIG. 3) edge of which the lug 6 of the terminal extends. From the opposite edge of the base 10 of each terminal there extends a wire connecting post 12 with an electrical component supporting and connecting member 14, in juxtaposed relationship. Each terminal 8 was made by stamping and forming a single piece of sheet metal stock, for example, brass stock. The member 14 comprises three parallel plates, 16, 18 and 20, respectively, which are connected to one another by smoothly rounded bights 22 and 24, the bight 22 connecting the plates 16 and 18 and the bight 24 connecting the plates 18 and 20. The plate 16 extends directly from the upper (as seen in FIGS. 1 to 4) edge of the base 10.

The terminal 8 may be assembled to the panel 2 by means of a conventional staking machine (not shown), the insertion of the terminals into the holes 4 being limited by the abutment of the plates 10 against the panel 2. As shown in FIG. 1, the holes 4 are arranged in two parallel rows, the terminals of one row being arranged in back-to-back relationship with those of the other two rows, that is to say the plates 16 of one row face the plates 16 of the other row. The holes of each row are equidistant, the spacing between the holes of the two rows being equal. Since the terminals 8 of one row are disposed in back-to-back relationship with respect to those of the other row, the rows are longitudinally offset from one another in such a way that the slots of the member 14 of each terminal of one row are at least substantially aligned with the slots of the member of a terminal of the other row.

As shown in FIG. 2, the assembly can be used for mounting electrical circuit components, for example, resistors or capacitors, C1 and C2, having bare lead wires W1 and W2, respectively, of different gauges. Only one lead wire of each component is shown.

The posts 12 serve, as shown in FIG. 2 (right-hand side), for the connection of external leads W3 to the electrical components. It will be apparent from FIG. 2 that the leads W3 have been applied to the post 12 by means of a wire wrapping tool (not shown). However, the leads W3 could be applied to the posts by other means, for example by securing the leads to the posts by means of electrical clips. Also, the posts 12 may be replaced by lead connecting means other than posts, for example, tabs for mating with electrical receptacles, solder tags, or crimping ferrules. The base 10 itself may serve as a lead connecting means in which case a lead W3 is simply soldered to the base 10. Further, the lug 6 may serve as a lead connecting means, being soldered to a printed or other conductor on the panel 2.

Figure 4:
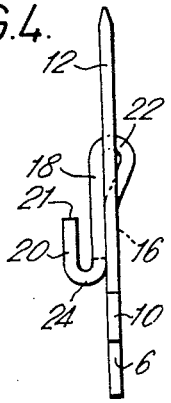
FIG. 4 is a view taken in the direction of the arrow A in FIG. 5.

As best seen in FIGS. 2 and 4, the plates 16 and 18 are almost contiguous but the plates 18 and 20 are spaced well apart from one another.

The bight 22 is formed with a central lead wire guiding mouth 26 which communicates with slots 28 and 30 formed in the plates 16 and 18, respectively. The left-hand (as seen in FIG. 3) wall of the slot 28 converges in a direction away from the mouth 26, towards the right-hand wall, the bottom of the slot 28 terminating in a parallel-sided wire gripping slot portion 31. In a similar manner, the right-hand wall 35, as seen in FIG. 3, of the slot 30, converges in a direction away from the mouth 26 towards the left-hand wall, the bottom of the slot 30 terminating in a parallel-sided wire gripping portion 33. The slot portions 31 and 33 are of equal width but are laterally offset, as seen in FIG. 3.

Figure 7:
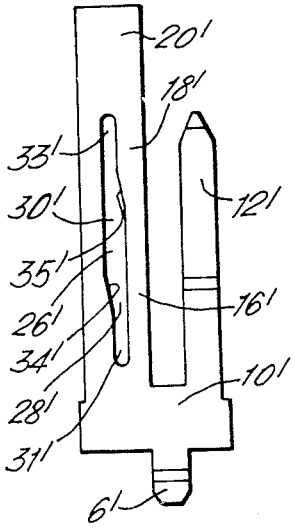
FIG. 7 is a plan view of a stamped sheet metal blank to be formed into a terminal according to the preceding Figures.

FIG. 7 shows a stamped sheet metal blank for the formation of the terminal 8, the parts of the blank corresponding to those of the finished terminal being similarly referenced but with the addition of a prime symbol.

To mount the components in the assembly, a lead wire of each component is inserted through the mouth 26 of each of two opposite members 14 of the two rows, in a direction at right-angles to the longitudinal axis of such end portion. Each lead wire end portion is then pressed down into the slots of the appropriate member 14, by means of a wire insertion tool (not shown), which may be a tool as described in the specification of our U.S. Pat. No. 3,628,202, so that the lead wire end portion is forced down into the portions 31 and 33 of the slots, the excess length of the lead wire portion being sheared off by cooperation between the edge 21 of the plate 20 and a severing blade (not shown) of the wire insertion tool.

As shown in FIG. 2, the lead wire W1 has been cranked in view of the large diameter of the component C1 to allow the insertion of the end portion of the wire W1 into the appropriate slots.

By virtue of the misalignment of the slot portions 31 and 33, the larger gauge lead wires W1 and the small gauge lead wires W2 can both be terminated without being sheared through or partially sheared through in such a way as effectively to impair the support of the components, as will now be described with reference to FIGS. 5 and 6.

Figure 5:
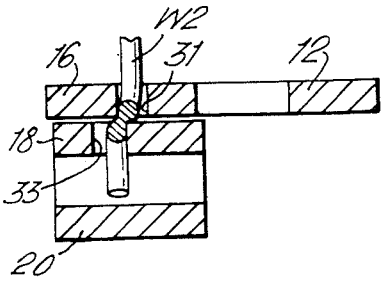
FIG. 5 is a view taken on the lines V—V of FIG. 3.

As shown in FIG. 5, which illustrates the termination of the smaller gauge lead wire W2, the wire W2 is of substantially smaller diameter than the width of either of the slot portions 31 and 33. However, as the end portion of the wire W2 is pushed down through the mouth 26, the engagement of such end portion with the inclined walls 34 and 35 of the slots 28 and 30 causes the plate 18 to be cammed laterally relative to the plate 16, such movement of the plate 18 being permitted by the resilience of the bight 22 and taking place against the spring action of the bight 22. As the plate 18 moves laterally relative to the plate 16, the slot portions 31 and 33 more nearly approach mutual alignment until the end portion of the wire W2 is received in both the slot portions 31 and 33. When the insertion force is released, the plate 18 returns towards its original position, also by virtue of the resilience of the bight 22, so that the end portion of the wire W2 is tightly gripped between the lower right-hand (as seen in FIG. 5) edge of the left-hand (as seen in FIG. 5) wall of the slot 31 and the upper left-hand (as seen in FIG. 5) edge portion of the right-hand (as seen in FIG. 5) wall of the slot 33.

Where a larger lead wire W1 is terminated, the plate 18 is displaced laterally to a greater extent than where the lead wire W2 is terminated, so that the slot portions 31 and 33 are brought substantially into alignment. The end portion of the wire W1 is tightly gripped by the walls of both slots 31 and 33. Since, however, the slot portion 31 is wider than the diameter of the smaller gauge lead wire W2, the wire W1 cannot be sheared or partially sheared by the wall of the slot portion 31 to such an extent as effectively to impair the support of the component C1. The tendency of the plate 18 to return under the resilience of the bight 22 enhances the gripping action of the slot walls.

Figure 6:
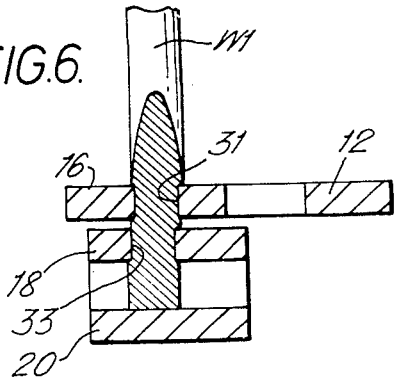
FIG. 6 is a view similar to that of FIG. 5 but showing a larger gauge lead wire connected to the terminal.

As the plate 18 is laterally displaced in the manner mentioned above, it also moves away from the plate 16, the extent of such movement increasing with the wire guage as will be apparent from a comparison of FIGS. 5 and 6.

As will be appreciated, lead wires of more than two different gauges may be terminated.

What is claimed is:

1. An electrical terminal comprising a pair of parallel plates, said plates being generally contiguous and being connected by a bight, a wire guiding mouth formed in said bight, and a wire receiving slot formed in each said plate and communicating with said mouth, said slots having gripping portions offset relative to each other and having an overlapping area, said slot gripping portions being substantially parallel to each other, with said overlapping area extending the entire depth of said slots, said plates being connected resiliently by the bight whereby the slots are moved more nearly into mutual alignment upon the insertion of a wire into both said slots by way of the mouth.

2. An electrical terminal comprising a pair of parallel plates connected by a bight which has a wire guiding mouth communicating with a lead wire receiving slot in each of the plates, one of said plates projecting from a first edge of a base, each slot having a wire gripping portion wherein the plates are substantially contiguous, the wire gripping portions of the slots being mutually misaligned, the plates being connected resiliently by the bight so that the slot portions are moved more nearly into mutual alignment upon the insertion of a common lead wire into both the slot portions by way of the mouth, a lug projecting from a second edge of the base and an external lead connecting post projecting from the first edge of the base such that the slots are generally parallel to the post.

* * * * *